US006783466B2

(12) United States Patent
Seki et al.

(10) Patent No.: US 6,783,466 B2
(45) Date of Patent: Aug. 31, 2004

(54) GOLF CLUB HEAD

(75) Inventors: Teruaki Seki, Tokyo (JP); Masaomi Hiruta, Tokyo (JP); Hideo Matsunaga, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/981,731

(22) Filed: Oct. 19, 2001

(65) Prior Publication Data

US 2002/0091015 A1 Jul. 11, 2002

(30) Foreign Application Priority Data

Oct. 19, 2000 (JP) ..... P.2000-319600
Aug. 9, 2001 (JP) ..... P.2001-242436

(51) Int. Cl.[7] ..... A63B 53/04
(52) U.S. Cl. ..... 473/345; 473/349
(58) Field of Search ..... 473/324, 329, 473/330, 335, 342, 345, 346, 349

(56) References Cited

U.S. PATENT DOCUMENTS 4,762,322 A * 8/1988 Molitor et al. ..... 473/345
5,120,061 A * 6/1992 Tsuchida et al. ..... 473/305
5,205,560 A * 4/1993 Hoshi et al. ..... 473/345
5,255,913 A * 10/1993 Tsuchida ..... 473/329
5,346,217 A * 9/1994 Tsuchiya et al. ..... 473/345
RE34,925 E * 5/1995 McKeighen ..... 473/305
5,706,566 A 1/1998 Igarashi ..... 29/527.5
5,755,627 A 5/1998 Yamazaki et al. ..... 473/345
RE35,955 E * 11/1998 Lu ..... 473/329
6,319,149 B1 * 11/2001 Lee ..... 473/342

* cited by examiner

*Primary Examiner*—Glenn Caldarola
*Assistant Examiner*—Tom P Duong
(74) *Attorney, Agent, or Firm*—Sughrue Mion, PLLC

(57) ABSTRACT

This golf club head is constituted by a front part 1 including a face portion 2 and a crown main portion 3, and a back part 10 forming the remaining portion of the golf club head. A metal material forming the front part 1 has lower Young's modulus than that of a metal material forming the back part 10. The front part 1 and the back part 10 are welded. The thickness of the center of the face portion 2 is larger than the thickness of the periphery thereof. The thickness of the vicinity of a highest point 3A of the crown is small.

21 Claims, 10 Drawing Sheets

GOLF CLUB HEAD

BACKGROUND OF THE INVENTION

1. Field of the Invention

The present invention relates to a golf club head having a hollow shell made of metal, and particularly relates to a golf club head in which a shell made of metal is thin enough to be deformed easily at a time of hitting a ball, so that a repulsive property is superior, and a large carry can be obtained.

2. Description of the Related Art

Hollow golf club heads made of metal are used widely as wood type golf club heads such as drivers or fairway woods. Generally, as shown in FIG. 14, a hollow wood type golf club head 321 has a face portion 322 for hitting a ball, a crown portion 323 forming a top surface portion of the golf club head, a sole portion 324 forming a bottom surface portion of the golf club head, a side portion 325 forming the toe-side, rear-side and heel-side side surface portions of the golf club head, and a hosel portion 326. A shaft 327 is inserted into the hosel portion 326 of the golf club head 321, and fixed thereto by a bonding agent or the like. Incidentally, recently, a lot of golf clubs called utility clubs have come onto the market. As a kind of such utility golf club, various golf clubs each having a head resembling the above-mentioned wood type golf club head (that is, having a face portion, a sole portion, a side portion, a crown portion and a hosel portion) have also come onto the market.

As metal forming such a hollow golf club head, aluminum alloys, stainless steel, or titanium alloys are used. In recent years, titanium alloys are especially used widely.

In recent years, in order to increase a carry of a shot, there have been adopted various structures in which a face of a golf club head is thinned to make a face surface easy to be deformed elastically at a time of impact so as to increase the initial speed of a ball. However, there may be a case that the initial launch speed of the ball is not increased sufficiently only by the elastic deformation of the face surface.

Particularly, for an amateur golfer who has a low head speed, a sufficient launch angle cannot be obtained with a head deformable only in a face. In addition, since the spin quantity of a ball may be reduced, increase in the initial speed of the ball does not result in increase in the carry of the ball.

It is an object of the present invention to provide a golf club head in which elastic deformation is produced not only in a face surface but also in a crown portion at a time of impact of a golf ball. Accordingly, the initial speed of the ball can be increased while the launch angle and the spin quantity can be increased. Thus, even if a powerless golfer uses the golf club head, the golfer can obtain a sufficient increase of a carry.

SUMMARY OF THE INVENTION

According to the invention, there is provided a hollow golf club head made of metal comprising a front part having a face portion and a crown portion and made of a homogeneous material and a back part having a sole potion, a side portion, and hosel portion, wherein the front part and the back part are welded.

In such a golf club head, the constituent material of the front part may be made lower in Young's modulus than the constituent material of the back part or a crown portion of the front part is formed to be thin. In this case, the front part as a whole can be made easy to be deformed elastically at a time of impact. Thus, at the time of impact, the elastic deformation is produced not only in the face surface but also in the crown portion. Accordingly, the initial speed of a ball can be increased while the launch angle and the spin quantity can be increased. Thus, even if a powerless golfer uses the golf club head, the golfer can obtain a sufficient increase of a carry.

According to the present invention, a center of the face portion may be the thickest portion of the face portion. In this case, the strength of the face portion center can be enhanced. When a peripheral area of the face surface is thinned, suitable deformation is produced in the face portion at the time of impact. Thus, the initial speed of the ball can be increased.

According to the present invention, the front part may include a highest portion of the crown portion, and the thickness of the highest portion and a neighbor area thereof may be made smaller than the thickness of a peripheral area of the neighbor area. In this case, the crown portion becomes easy to be deformed at the time of impact. Thus, the initial speed of the ball can be further increased.

DETAILED DESCRIPTION OF THE PREFERRED EMBODIMENTS

Embodiment 1

Figure 1:
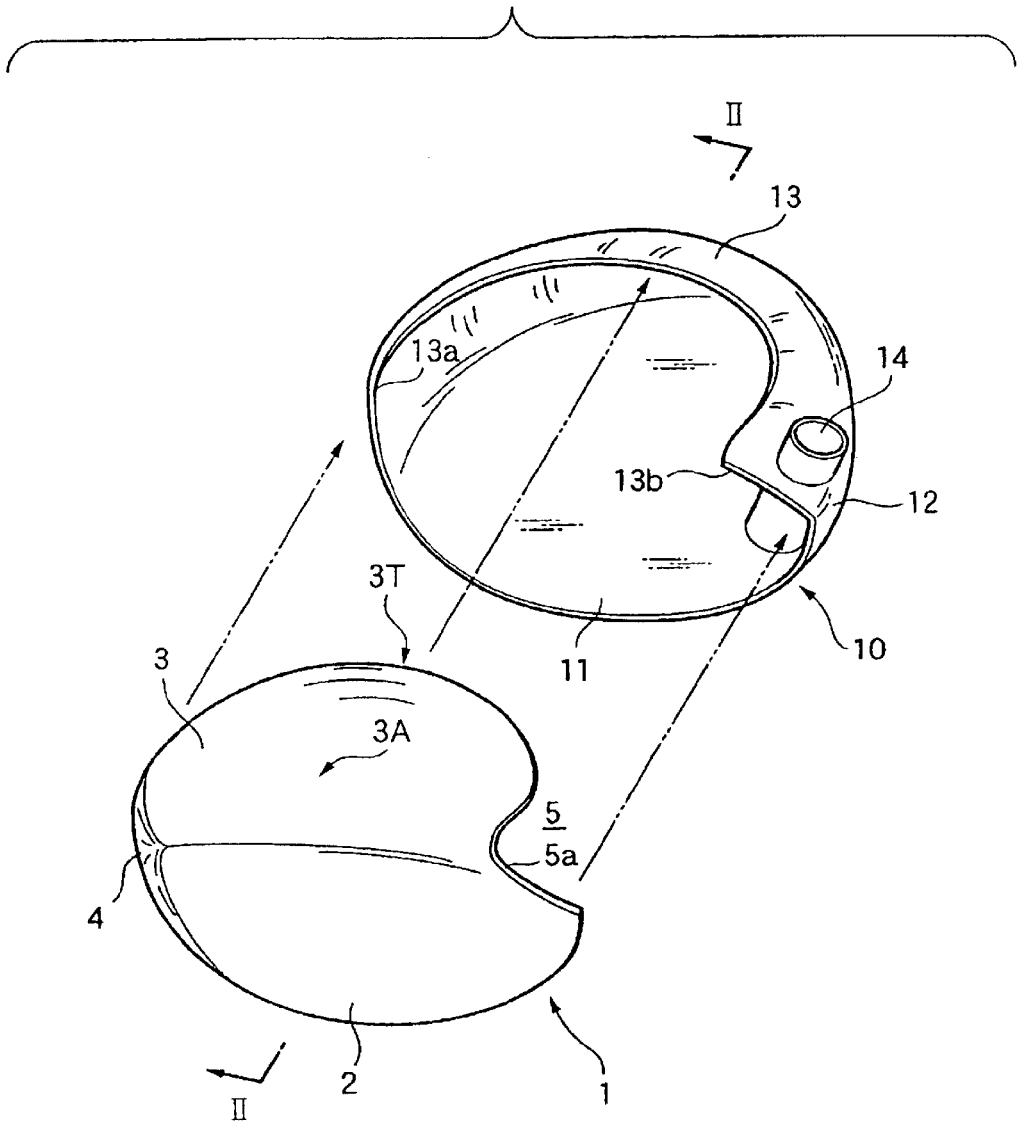
FIG. 1 is an exploded perspective view of a golf club head according to an embodiment 1.
Figure 2:
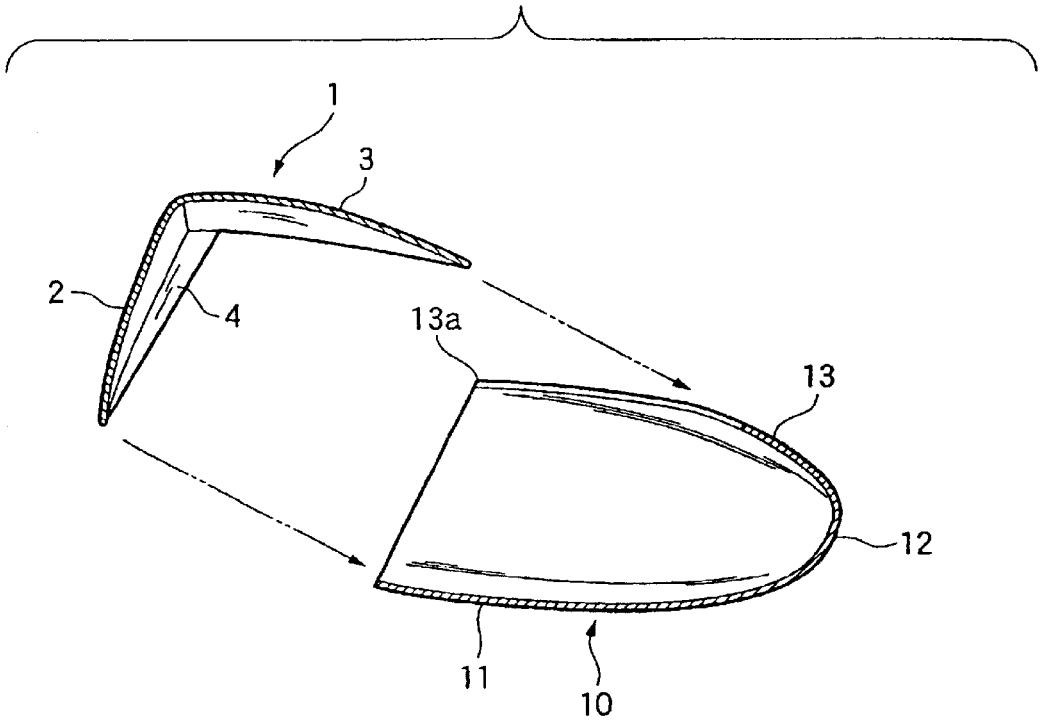
FIG. 2 is an exploded sectional view taken on line II—II in FIG. 1.
Figure 3:
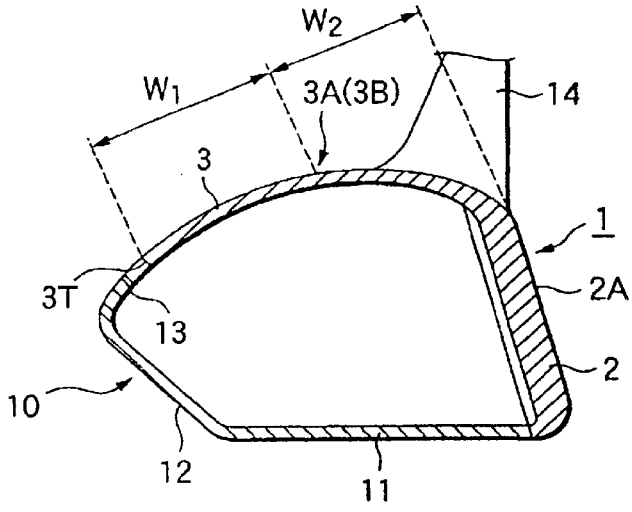
FIG. 3 is a sectional view taken on line II—II in FIG. 1 when the golf club head is jointed.
Figure 4:
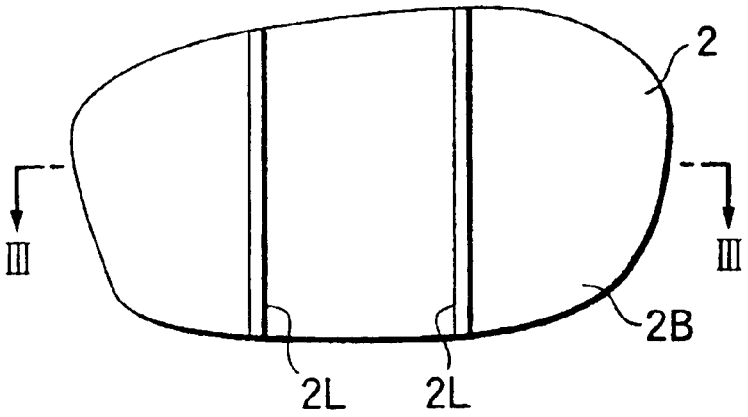
FIG. 4 is a back view of a face portion 2.
Figure 5:
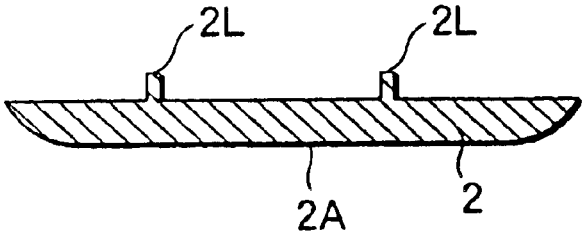
FIG. 5 is a sectional view taken on line III—III in FIG. 4.

An embodiment 1 will be described below with reference to the drawings. FIG. 1 is an exploded perspective view of a golf club head according to the embodiment 1. FIG. 2 is an exploded sectional view taken on line II—II in FIG. 1. FIG. 3 is a sectional view taken on line II—II in FIG. 1 when the golf club head is jointed. FIG. 3 is a side view from the heel side of FIG. 1. FIG. 4 is a back view of a face portion 2. FIG. 5 is a sectional view taken on line III—III in FIG.

Figure 6:
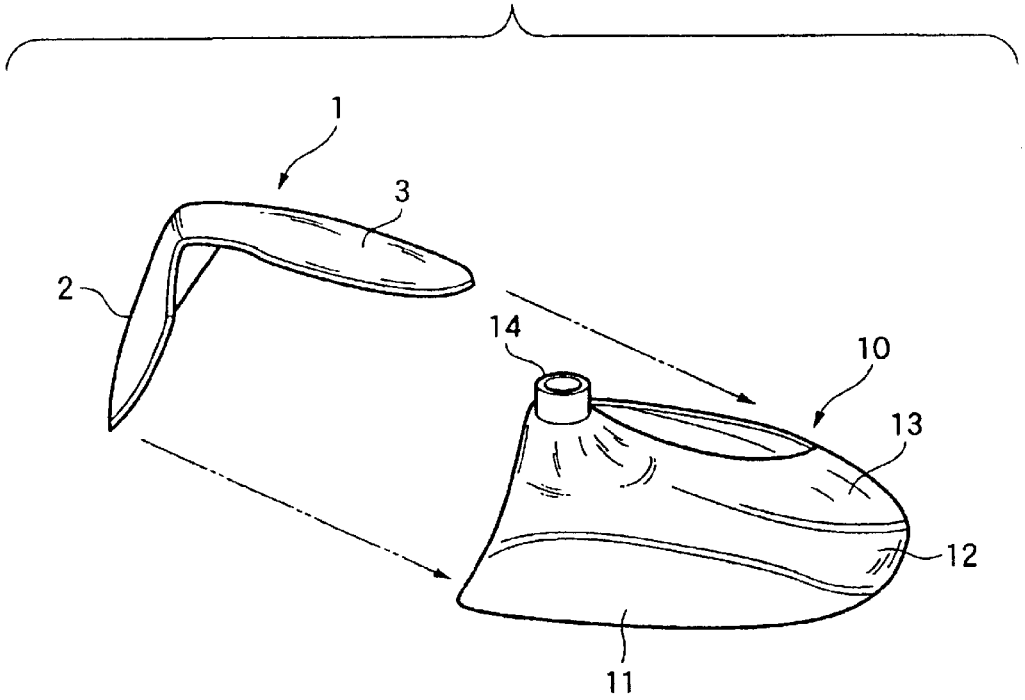
FIG. 6 is an exploded side view from a heal side of the golf according to the embodiment 1.
Figure 7:
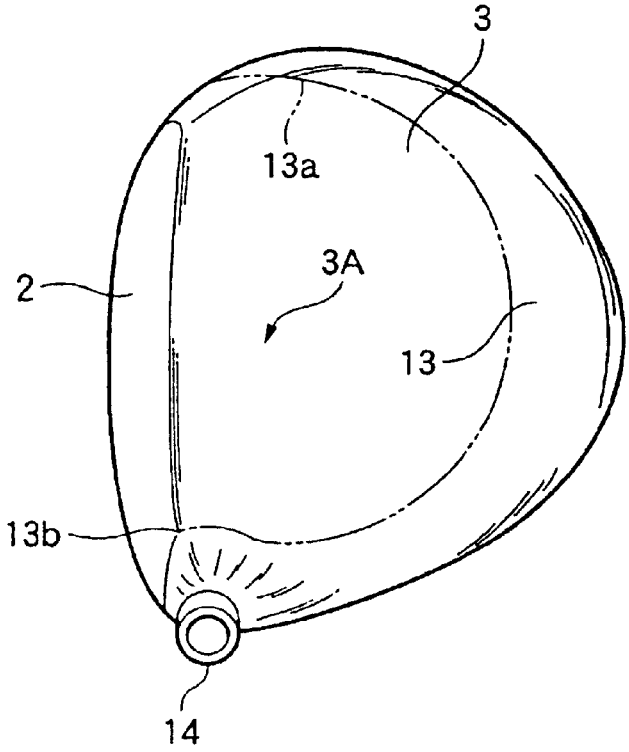
FIG. 7 is a plan view of the golf club head according to the embodiment 1.
Figure 8:
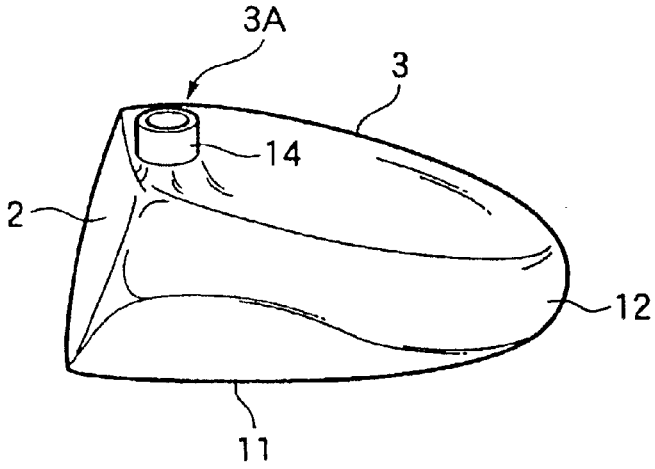
FIG. 8 is a side view from the heal side of the golf club head according to the embodiment 1.

4. FIG. 6 is an exploded side view from a heal side of the golf according to the embodiment 1. FIG. 7 is a plan view of the golf club head according to the embodiment 1. FIG. 8 is a side view from the heal side of the golf club head according to the embodiment 1.

This golf club head is a golf club head having a hollow metal shell and comprises a front part 1 formed of a face portion 2 and a crown main portion 3, and a back part 10 forming the remaining portion. A metal material forming the front part 1 has an Young's modulus the same as or lower than that of a metal material forming the back part 10.

The back part 10 has a sole portion 11, a side portion 12 forming toe-side, rear-side and heel-side side circumferential wall surface portions of the golf club head, a crown circumferential portion 13 extending along the side portion 12, and a hosel portion 14. The crown circumferential portion 13 starts near a toe-side front end of the side portion 12, and extends to go around the side portion 12 from the rear side thereof to the heel side thereof.

On the toe side, the projecting width of the crown circumferential portion 13 toward a crown portion center becomes larger gradually as it goes to the rear side of the golf club head. In other words, on the toe side, the projecting width of the crown circumferential portion 13 toward the crown portion center becomes smaller as it approaches the face portion, and the projecting width of the crown circumferential portion 13 becomes zero near the front end. This point is a start end portion 13*a* of the crown circumferential portion 13.

In this embodiment, this start end portion 13*a* coincides with a front end of an upper edge of the toe-side of the side portion 12 of the back part 10.

The front part 1 integrally has a very small side front portion 4 connected to the toe-side of the side portion 12. The side front portion 4 is formed into a triangular joint plate connected to the crown main portion 3 and the face portion 2 in a crossing corner portion in which the crown main portion 3 and the face portion 2 cross each other in an L-shape. The side front portion 4 and the toe-side of the side portion 12 of the back part 10 are joined integrally with each other by welding so as to form a toe-side of a side portion of the golf club head.

The crown circumferential portion 13 projects like eaves toward the crown center of the golf club head. A front-side projecting end portion 13*b* on the heel side of the crown circumferential portion 13 engages with a corner portion 5*a* of a notch-like ingrowing portion 5 of the front part 1.

Near the face portion 2 on the heel side of the crown circumferential portion 13, the hosel portion 14 projects upward. The hosel portion 14 is cylindrical. The shaft (not shown) is inserted into the hosel portion 14 and fixed thereto by a bonding agent.

The hosel portion 14 reaches the sole portion 11 from a lower surface side of the crown circumferential portion 13. In a circumferential area of the hosel portion 14, the crown circumferential portion 13 has a substantially conical shape with a rising gradient toward the hosel portion 14.

Figure 9:
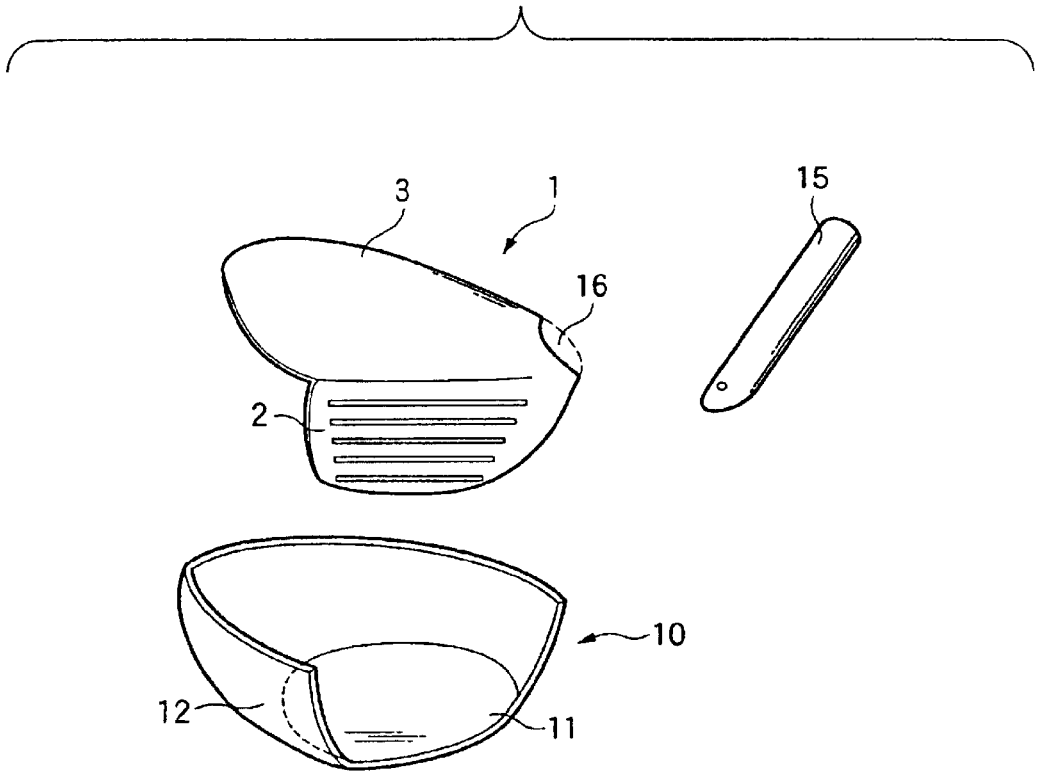
FIG. 9 is an exploded perspective view of a golf club head, in which a hosel portion is an opening formed by welding a front part formed by forging and a back part formed by forging or press forging.

Incidentally, as shown in FIG. 9, the hosel portion 14 may not be some member, but may be an opening 16 inserted the shaft 15. In FIG. 9, the opening 16 is formed at a time when the front part 1 and the back part 10 are welded.

The crown main portion 3 has a sectionally arched shape from the face portion 2 side to the back part 10 so as to bulge upward. Thus, when a ball is hit by the face surface, the crown main portion 3 is bent further upward so as to bring an effect to enhance the repulsion of the ball. The front part 1 includes a highest point 3A and a center peak 3B of the crown portion 3. The crown main portion 3 of the front part 1 extends from the upper end of the face portion 2 to the back part side. This extending length is preferably not shorter than 25 mm, especially not shorter than 30 mm. That is, in FIG. 3, W1+W2 is preferably not shorter than 25 mm, especially not shorter than 30 mm. Particularly, it is preferable that W1 is not shorter than 20 mm. As shown in FIG. 7, the planar shape of the crown main portion 3 is a substantially semicircular shape. The crown main portion 3 and the crown circumferential portion 13 are welded to form the crown portion of the golf club head.

Figure 10:
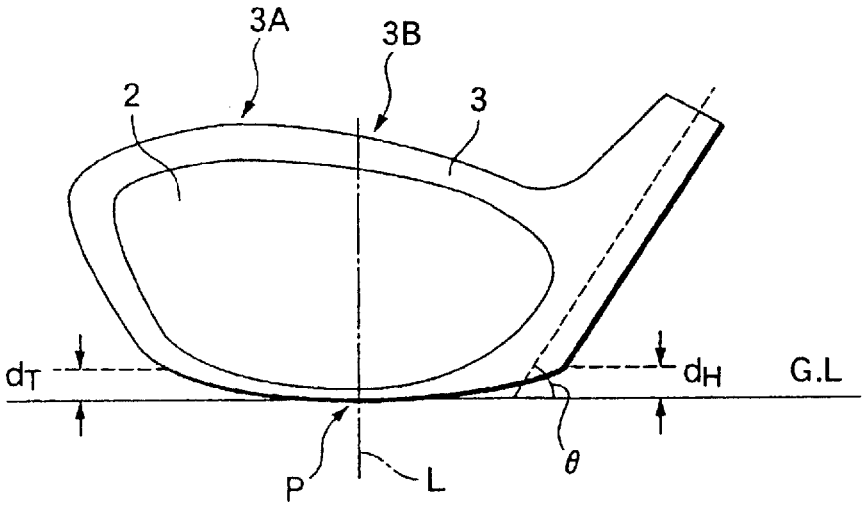
FIG. 10 is a front view of a golf club head from a face surface side in a state where a face portion has been detached.

Incidentally, definitions of "the highest point" and "the center peak" will be described with reference to FIG. 10 which is a front view of the golf club head viewed from the face surface side in a state where the face portion has been detached. As shown in FIG. 10, the golf club head is set in a measuring instrument so that gaps $d_T$ and $d_H$ at toe-side and heel-side opposite ends of the sole are equal to each other. An angle θ at this time is a lie angle. Next, a contact point P between the sole portion 11 and the ground line (G.L) is set as a face center position L in a left/right direction, and the slice angle is set to 0 degree. At this time, in the crown portion 3, the highest position is the head highest point 3A, and the highest position in the face center position L is the center peak 3B.

The thickness of the highest point 3A and a neighbor area thereof (preferably an area with radius 10 to 30 mm around the highest point 3A) is smaller than the thickness of a peripheral area of the neighbor area.

In order to make the crown main portion 3 easy to bend so as to enhance the repulsive property thus, it is preferable that the crown portion is made thin. It is therefore preferable that the crown main portion 3 and the face portion 2, not including the hosel portion 14, are integrated so that the crown portion is finished to be thin.

As a metal material of this hollow golf club head, especially stainless steel, a titanium alloy, or fiber reinforced metal is preferable.

It is preferable that the front part 1 is especially an investment casting. It is very preferable that the front part 1 is cast in a vacuum casting method because defects such as cavities or the like can be reduced. The front part 1 may be formed by plastic forming such as hot forging, press working, or the like. The back part 10 has a complicated shape including the hosel portion 14. Thus, the back part 10 is preferably produced by casting. However, the back part 10 may be produced as follows. That is, the hosel portion 14 and other portions are press-molded separately, the hosel portion 14 is machined out of a columnar round bar or the like, and then, the hosel portion 14 and the other portions are jointed to each other by welding or the like. An example in which the parts forming the back part 10 is formed separately and are welded to integrate the parts will be described later in an embodiment 2.

It is preferable that a circumferential edge portion where the front part 1 and the back part 10 are welded is provided so that thick portions, which are thicker than peripheries thereof, are sequentially provided. Particularly, it is preferable that the joint portion between the crown main portion 3 and the crown circumferential portion 13 is made thick. When the thickness of the joint portion is increased thus, sinking or cracking around the welding is prevented. The thickness of the thick portion for junction is preferably in a range of from 1 mm to 3 mm, more preferably in a range of from 1.4 mm to 2.0 mm. However, if the joint portion were made too thick, extra weight would increase undesirably. It is preferably that the thickness of the periphery of the highest point 3A of the crown portion (including the points 3A and 3B on the crown portion) is in a range of from 0.6 mm to 1.2 mm, especially in a range of from 0.8 mm to 1.0 mm. By thinning the vicinity of the highest point 3A of the crown portion, not only the face but also the crown portion become easy to be deformed at the time of impact. As a result, the initial speed of a ball increases, and the launch angle can be further increased easily. It is preferable that the thickness of the vicinity of the highest point 3A of the crown portion is smaller than the thickness of the face portion, especially smaller than the thinnest portion of the face portion. The thickness of the crown main portion 3 is gradually smaller as it approaches from the face portion 2 side toward the highest portion 3A of the crown portion.

If the thickness near the point 3A was smaller than 0.5 mm, it would be difficult to manufacture the crown main portion 3. On the other hand, if the thickness near the point 3A was larger than 1.2 mm, sufficient bending could not be obtained. Incidentally, the thickness of the front edge (portion closest to the face portion 2) of the crown main portion 3 is preferably in a range of from 0.2 mm to 1.0 mm to be larger than the thickness at the point 3A.

Although the crown portion is formed of the crown main portion 3 and the crown circumferential portion 13 in the above-mentioned embodiment, the crown portion as a whole may be integrated with the face portion 2.

The crown main portion 3 and the crown circumferential portion 13 in the above-mentioned embodiment are divided to follow substantially the contour drawn on the basis of the highest point 3A when the golf club head is soled on a horizontal plane. With such a configuration, the welding quantity of the crown main portion 3 and the crown circumferential portion 13 can be reduced while the crown portion becomes easy to bend.

It is preferable that a chamfered portion is provided at the lower edge of the face, or a part of the sole portion is formed integrally with the face portion. Thus, a sinking portion caused by welding does not cover the face surface.

It is preferable that the front part 1 and the back part 10 are joined to each other by arc welding. It is preferable that a titanium alloy or the like is welded in an atmosphere of inert gas such as argon or the like.

In addition, by making the thickness of a center area of the face surface of the face portion 2 larger than the thickness of the peripheral area thereof, the initial speed of the ball can be further increased. The thickness of the thickest portion of the center area is not smaller than 2 mm, preferably not smaller than 2.3 mm, more preferably not smaller than 2.6 mm, and not larger than 3.5 mm, preferably not larger than 3.2 mm, more preferably not larger than 2.8 mm. The thickness of the thinnest portion of the peripheral area is not smaller than 1 mm, preferably not smaller than 1.2 mm, more preferably not smaller than 1.6 mm. The reason why the center area is made thick is to obtain sufficient strength because the center area is easiest to bend at the time of impact. It will go well if the difference in thickness between the thickest portion and the thinnest portion is in a range of from 0.2 mm to 1.0 mm, preferably in a range of from 0.3 mm to 0.8 mm.

However, if the center area is made too thick, the face surface side increases in weight so that the center of gravity is located forward. Thus, for a wood type golf club, particularly for a club with a loft angle lower than 15°, a ball becomes difficult to launch upward. By setting the thickness of the peripheral area of the face surface to be in the suitable thickness range, suitable elastic deformation is produced at the time of impact so that the initial speed of the ball can be increased.

The back part 10 may be produced by casting, or may be molded out of a metal thin plate by press working, or may be molded by forging.

It is preferable that the thickness of the side portion 12 is made smaller than the thickness of the face portion 2 and substantially equal to the thickness of the crown main portion 3. The side portion 12 may be formed integrally with the front part 1. It is more effective that the front part 1 includes a part of the side portion as shown in FIG. 1 (in FIG. 1, the side front portion 4 is included), in terms of the effect to improve the repulsive property.

When the front part 1 alone or the front part 1 further integrated with the side portion 12 is formed by hot forging, it may be difficult to form the shape of the portion including the face portion 2 and the crown main portion 3 and/or further the side portion 12 by plastic forming based on one-time forging. In such a case, it is preferable that the face portion 2 and the thin crown main portion 3 and/or further the side portion 12 are molded precisely through a plurality of times of forging stages, for example, a plurality of times of forging stages of rough forging, main forging and finish forging.

In addition, when one rib or a plurality of ribs in the front/rear direction (from the face side to the rear side) of the sole portion are provided, the rigidity of the sole portion can be enhanced. Thus, the crown portion can be made easy to be deformed, and the launch angle of a ball can be easy to be made high. In addition, the center of gravity can be made low. One recess portion or a plurality of recess portions in the front/rear direction may be provided in the sole portion in place of such ribs.

If ribs 2L are provided in a back surface 2B of the face portion 2, oscillation produced when the face portion 2 hits a ball to be deformed the face portion 2 is damped so that the sense of hitting the ball can be improved. Each of the ribs 2L is preferably provided so as to extend in the height direction of the face portion 2 and over a length ½ or more times as long as the height-direction length of the face portion 2. It is preferable that the rib 2L has a width in a range of from 1 mm to 4 mm, and a height in a range of from 1 mm to 3 mm. It is preferable that approximately two to six of such ribs are provided particularly to be line-symmetrical with respect to the face center.

As the metal for forming the metal shell of the golf club head according to the invention, especially stainless steel or titanium alloys are preferable. Particularly, β titanium alloys, that is, alloys such as Ti-15Mo-5Zr-3Al, Ti-15V-3Cr-3Sn-3Al, etc., or alloys such as Ti-4.5Al-3V-2Mo-2Fe, Ti-6Al-4V, Ti-6Al-7Nb etc., are preferable.

First, a case of manufacturing the front part 1 by casting will be given. In comparison with stainless steel, a titanium alloy for casting has Young's modulus of about 110,000 $N/mm^2$, so that the face surface or the like becomes easy to bend suitably. Ti-6Al-4V used generally has Young's modulus of about 112,700 $N/mm^2$. Particularly Ti-6Al-7Nb has strength substantially equal to that of Ti-6Al-4V, but the Young's modulus is low to be 102,000 $N/mm^2$. Thus, Ti-6Al-7Nb is preferred because the bending of the face surface and the crown portion can be utilized. When such a titanium alloy having low Young's modulus is used for the front part while a titanium alloy having high Young's modulus is used for the back part, the face portion and the crown portion becomes easy to bend suitably.

Next, a case of manufacturing the front part 1 by plastic forming will be given. It is preferable that the metal for forming the front part 1 is easy to plastic-form. For example, a Ti-4.5Al-3V-2Mo-2Fe alloy (SP700) which is lower by 100° C. in processing temperature than a Ti-6Al-4V alloy, which contains many β stabilized elements, and which is improved in workability, is preferred. When a titanium alloy having low Young's modulus is used for the front part while a titanium alloy having high Young's modulus is used for the back part, the face portion and the crown portion becomes easy to bend suitably. β titanium alloys, which is lower in Young's modulus than Ti-6Al-4V of general titanium alloy, are such as Ti-15V-3Cr-3Sn-3Al, Ti-13V-11Cr-3Al, or the like.

Although the kind of head to which the golf club head according to the present invention is applied is not especially limited, a wood-type golf club, particularly a driver is preferable. That is, generally, a golfer often hits a ball in the upper of the face surface of a driver because the ball is teed up to be hit. Accordingly, when the present invention is applied to a driver, the crown portion becomes easy to bend, and the launch angle also increases, so that the carry increases conspicuously.

The driver in the present invention means a club with the loft angle of not larger than 15 degrees and with the club length of not shorter than 109 cm (43 inches).

When the present invention is applied thus to a wood-type golf club, particularly to a driver, the larger the volume of the head is, the wider the area of the crown portion is. Thus, the effect appears conspicuously. It is therefore preferable that the golf club head according to the present invention has a head volume of not smaller than 250 $cm^3$ (ml), especially not smaller than 300 $cm^3$ (ml), and a head maximum height of not lower than 48 mm, especially not lower than 52 mm. However, if the head volume or the head height were too large, the head would not be suitable as a golf club head. It is suitable that the head volume is not larger than 500 $cm^3$ and the head maximum height is not higher than 68 mm.

Embodiment 2

Next, an embodiment 2 of the invention will be given with reference to the drawings. Incidentally, a member, which is the same as the embodiment 1, is allotted the same number and explanation of the member is omitted.

Figure 11:
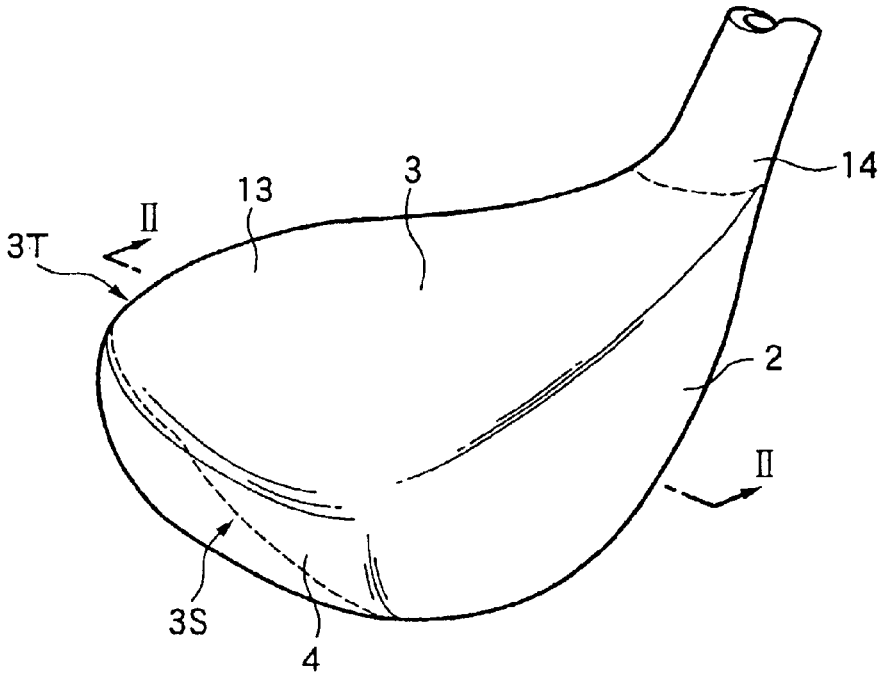
FIG. 11 is a perspective view of a golf club head according to an embodiment 2.
Figure 12:
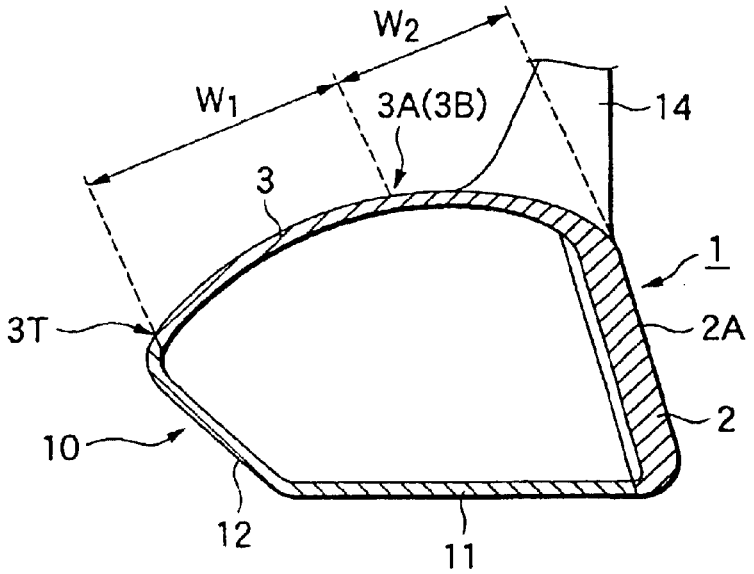
FIG. 12 is a sectional view taken on line II—II in FIG. 11.
Figure 13:
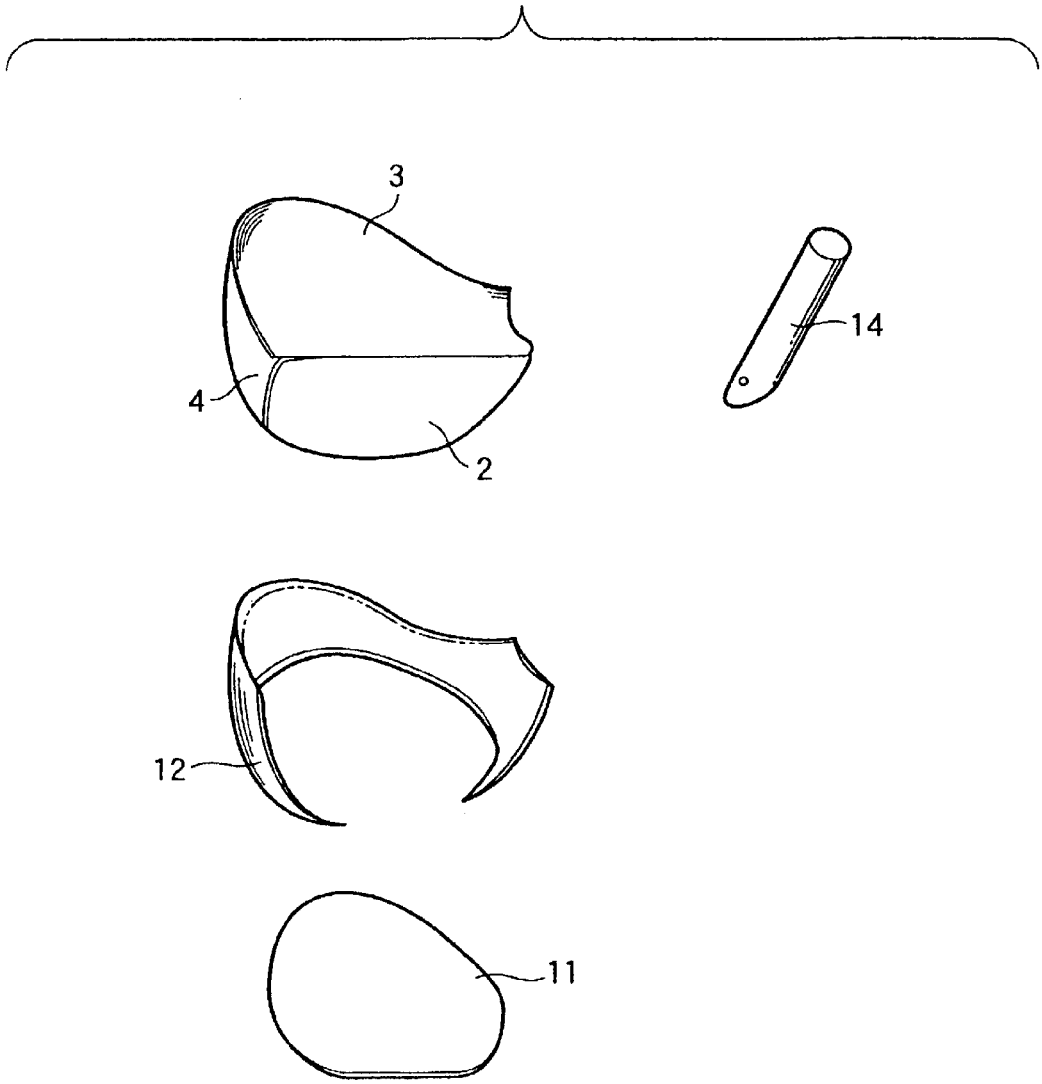
FIG. 13 is an exploded perspective view of the golf club head according to the embodiment 2.
Figure 14:
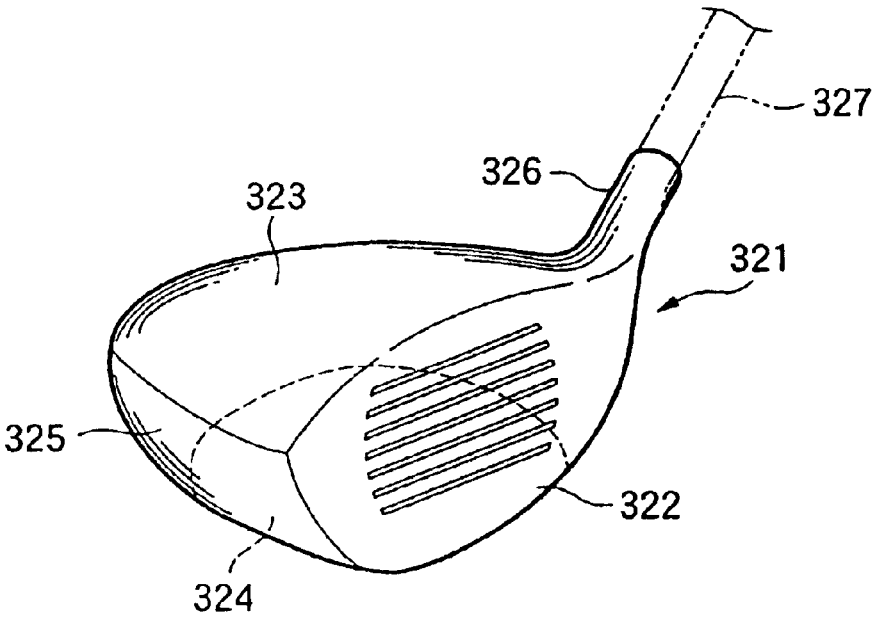
FIG. 14 is an explanatory view of a golf club head according to a related art.

FIG. 11 is a perspective view showing a golf club head according to the embodiment 2. FIG. 12 is a sectional view taken on line II—II in FIG. 11. FIG. 13 is an exploded perspective view showing the golf club head according to the embodiment 2. In FIG. 11, the dotted line designates a front part including a face portion 2 and a crown portion.

The embodiment 2 is different from the embodiment 1 in that each of members is manufactured in advance and the members are welded with each other to form a back part 10. Other points are the same as the embodiment 1. As shown in FIG. 13, a sole portion 11, a side portion 12, and a hosel portion 14 are formed individually. In FIG. 13, the crown portion has a crown main portion 3 and a crown circumferential portion 13. However, the crown circumferential portion 13 and the side portion 12 may be formed integrally. Each of portions are formed by casting, press molding a thin metal plate, plastic forming, or the like. In relation to a portion including the sole portion 11, it is preferable to use a material having higher Young's modulus than the front part 1 or to be formed by casting so that the vicinity of the top portion of the crown portion can be bent easily. In a case of forming the hosel portion 14 and other portion integrally, since shape thereof is complicated, it is preferable that the portion including the hosel portion 14 is formed by casting.

For the portion including the sole portion 11, it is more preferable that a material has higher Young's modulus than the front part 1 or the portion is molded by casting. In this case, the vicinity of the top portion of the crown portion can be bent easily.

EXAMPLE

The present invention will be described below more specifically together with an example and a comparative example.

Examples 1 and 2

Golf club heads in Examples 1 and 2 had a configuration described in the embodiment 1. In Example 1, a Ti-6Al-4V alloy was used for the front part 1 formed by integrally casting the face portion and the crown portion. On the other hand, in Example 2, a Ti-6Al-7Nb alloy was used. The thickness of the center portion of the face portion was set to 3 mm, and the thinnest portion of the peripheral portion of the face was set to 2.5 mm. The average thickness of the crown portion was set to about 1.2 mm, and the thickness of the vicinity of the crown highest portion was set to about 0.9 mm. The head body portion including the sole portion and the hosel portion was produced by casting with a Ti-6Al-4V alloy in each of Examples 1 and 2. The thickness of the sole portion and the side portion was 1.2 mm.

A margin having a welding thickness of 1.5 mm was provided in the welded portion other than the face portion between the front part 1 and the back part 10. The front part 1 and the back part 10 were firmly fixed by welding in an argon atmosphere.

Incidentally, the Young's modulus of Ti-6Al-7Nb was 102,000 ($N/mm^2$) (about 102 (GPa)), and the Young's modulus of Ti-6Al-4V was 112,700 ($N/mm^2$) (about 113 (GPa)).

Comparative Example 1

A head body was made of a Ti-6Al-4V alloy. An opening was provided in a face portion of the head body, and a face member made of the same Ti-6Al-4V alloy was fitted and welded to the opening portion. Thus, a golf club head was produced. The thickness of the face portion of the face member was 3 mm. The golf club head had the same shape as those in Examples 1 and 2. In each golf club head, the highest portion of the crown portion was located at a point 26 mm behind the face.

Table 1 shows the configurations of Example 1 and 2 and Comparative Example 1 which are collected and arranged in order.

TABLE 1

| | Front part | Back part | structure |
|---|---|---|---|
| Ex.1 | Ti-6Al-4V | Ti-6Al-4V | Golf club head using front part in which face portion and crown portion were cast integrally |
| Ex.2 | Ti-6Al-7Nb | Ti-6Al-4V | |
| Comp. Ex.1 | Ti-6Al-4V | Ti-6Al-4V | Golf club head in which face member was fixedly fitted to head body portion provided with opening portion in face portion |

A 4.5-inch (114 mm) carbon shaft was attached to each golf club head. Thus, golf club heads were produced. Table 2 shows the test shot evaluation results of the golf club heads with a swing robot.

TABLE 2

| | head speed | Ball initial speed | Launch angle | back spin | carry | total distance |
|---|---|---|---|---|---|---|
| Ex. 1 | 42.2 (m/s) | 60.0 (m/s) | 14.1° | 2994 (rpm) | 216 (m) | 228 (m) |
| Ex. 2 | 42.2 (m/s) | 60.5 (m/s) | 14.2° | 2984 (rpm) | 218 (m) | 231 (m) |
| Comp. Ex. 1 | 42.3 (m/s) | 59.0 (m/s) | 13.9° | 3630 (rpm) | 209 (m) | 220 (m) |

As shown in the above results, according to the examples of the present invention, the crown portion is so easy to bend that the repulsive force of a ball is improved, and the carry is improved conspicuously. When the difference in Young's modulus between the front part and the back part is made not smaller than 10,000 N/mm$^2$ (about 10 (Gpa)) as that in Example 2, the carry of the ball is further increased.

Example 3

A golf club head of the example 3 has a structure described in the embodiment 2. A round bar of a Ti-4.5Al-3V-2Mo-2Fe alloy (SP700) produced by a forging machine was used to manufacture a golf club head according to the present invention shown in FIG. 11. First, this round bar was heated to about 800° C., and a face portion and a crown portion were molded integrally by hot forging. This molding was performed through three times of hot forging stages of rough forging, main forging and finish forging.

In the obtained front part, the thickness of a center of the face portion was 2.7 mm, the thick ness of a periphery of the face portion was 2.3 mm, and two ribs 3 mm wide and 0.3 mm high were provided in a back surface portion. These ribs were provided to extend in the height direction of the face portion and substantially over the whole area of the height thereof. The ribs were formed at an interval of 30 mm so that the center portion between the ribs was located in the face center position. The crown portion was formed into a sectionally arched shape bulging upward in the section from the face side to the back side in the face center position.

The thickness of the crown portion was set to 1.5 mm at the front edge along the face portion, 1.0 mm at the rear edge 3T, 1.0 mm at the side edge 3S of the side portion, and 0.8 mm near the highest point 3A and the center peak 3B. The thickness of the crown portion was reduced gradually as it approached the vicinities of the points 3A and 3B. The average thickness of the crown portion was 1.0 mm.

The highest point 3A and the center peak 3B were located 21mm and 20 mm behind the front edge of the crown portion respectively ($W_2$=21.20/mm). The distance $W_1$ was set to 25 mm.

Separately, the sole portion and the side portion which were other portions of the head were molded out of a Ti-6Al-4V alloy by casting so as to be integrated with the hosel portion and have an average thickness of about 1.2 mm.

Then, the front part and the sole/side/hosel integral part (the back part) were firmly fixed by welding so as to manufacture a golf club head (Example 3). The head volume of this golf club head was 310 cm$^3$ (ml), and the head weight (mass) was 192 g. The head maximum height, that is, the distance between the sole bottom surface and the head portion top surface at the head highest point 3A was 53.5 mm.

Comparative Example 1

For comparison, a golf club head was manufactured integrally by a casting method. In this Comparative Example 1, the crown portion was set to 1.2 mm thick uniformly. The other configuration was the same as that in Example 3, as shown in Table 3.

A shaft was attached to each of the golf club heads of Example 1 and Comparative Example 1. Thus, golf clubs were assembled. The specifications of the golf clubs were shown in contrast in Table 1.

TABLE 3

| | | Example. 1 | Comp. Ex. 1 |
|---|---|---|---|
| face portion and crown portion | Material | Ti-4.5Al-3V-2Mo-2Fe | Ti-6Al-4V |
| sole portion and others | Material | Ti-6Al-4V | Ti-6Al-4V |
| Thickness of face portion (mm) | | 2.7 | 2.7 |
| number of ribs | | 2 | 2 |
| head maximum height (mm) | | 53.5 | 53.5 |
| height of crown portion highest point 3A (mm) (height from face surface upper end portion) | | 21.0 | 21.0 |
| Thickness of crown portion highest point 3A (mm) | | 0.8 | 1.2 |
| crown portion average thickness (mm) | | 1.0 | 1.2 |
| loft angle | | 11° | 11° |
| head weight (mass) (g) | | 192 | 193 |
| head volume (cm$^3$ (ml)) | | 310 | 309 |
| club length (cm) | | 114.3 | 114.3 |
| club weight (mass) (g) | | 298 | 299 |

Real hitting evaluations were carried out with the respective golf clubs, and carries and so on were measured. The results are shown in Table 2.

TABLE 4

| | head speed (m/s) | ball initial speed (m/s) | meet rate | carry (m) | total distance (m) |
|---|---|---|---|---|---|
| Ex. 3 | 47.1 | 67.4 | 1.43 | 221 | 232 |
| Comp. Ex. 3 | 47.3 | 65.2 | 1.38 | 212 | 220 |

As is apparent from Table 4, by use of the golf club head according to the present invention, the repulsive property of a ball was enhanced so that the ball initial speed increased, and the carry increased.

As described above, the present invention can provide a golf club head in which relatively large elastic deformation is produced not only in a face surface but also in a crown portion at the time of impact of a golf ball. Accordingly, the initial speed of the ball can be increased while the launch angle and the spin quantity can be increased. Thus, by use of the golf club head, even a powerless golfer can obtain a sufficient increase of a carry.

What is claimed is:

1. A hollow golf club head made of metal comprising:

a front part having a face portion and a crown portion integrally and made of a homogeneous material; and a back part having a sole portion, a side portion, and a hosel portion, wherein the front part and the back part are welded; and wherein the front part is lower in Young's modulus than the back part.

2. The golf club head according to claim 1, wherein the back part is made of a homogeneous material.

3. The golf club head according to claim 1, wherein the back part is formed by welding a plurality of parts.

4. The golf club head according to claim 1, wherein the back part has toe-side, rear-side and heel-side side circumferential edges of said crown portion.

5. The golf club head according to claim 1, wherein the hosel portion is an opening formed at a time when the front part and the back part are welded.

6. The golf club head according to claim 1, wherein the front part further has a part of the side portion and is made of the homogeneous material.

7. The golf club head according to claim 1, wherein the front part includes the highest portion of the crown portion.

8. The golf club head according to claim 7, wherein an area with radius 30 mm around the highest portion of the crown portion is thinner than other area of the crown portion.

9. The golf club head according to claim 7, wherein the highest portion of the crown portion has a thickness in a range of 0.6 mm to 1.2 mm.

10. The golf club head according to claim 7, wherein the thickness of the crown is gradually thinned from the face portion side to the highest portion.

11. The golf club head according to claim 1, wherein a center of the face portion is the thickest portion of the face portion.

12. The golf club head according to claim 1, wherein a center of the face portion has a thickness in a range of 2 mm to 3.5 mm.

13. The golf club head according to claim 1, wherein the thinnest portion of the face portion has a thickness more than 1 mm.

14. The golf club head according to claim 1, wherein a junction portion between the front part and the back part has a thickness in a range of 1 mm to 3 mm.

15. The golf club head according to claim 1, wherein the crown portion covers the whole of the crown of the golf club head.

16. The golf club head according to claim 1, wherein the crown portion lengthens more than 25 mm toward a rear direction.

17. The golf club head according to claim 1, wherein a plurality of ribs are formed on a back surface of the face portion.

18. The golf club head according to claim 1, wherein a head volume of the golf club head is in a range of 250 $cm^3$ to 500 $cm^3$.

19. The golf club head according to claim 1, wherein a head height of the golf club head is in a range of 48 mm to 68 mm.

20. The golf club head according to claim 1, wherein the front part includes a highest portion and a center portion of the crown portion; and wherein the front part and the back part are welded at a position more rearward than both of the highest portion and the center portion.

21. The golf club head according to claim 1, wherein thickness of the crown portion decreases as approaching vicinity of a highest portion and a center portion of the crown portion.

* * * * *